US006098352A

United States Patent [19]

Coffen

[11] Patent Number: 6,098,352

[45] Date of Patent: Aug. 8, 2000

[54] DECK ASSEMBLY

[76] Inventor: Louis W. Coffen, 60 Beechford Rd., Pittsburgh, Pa. 15235

[21] Appl. No.: 09/143,473

[22] Filed: Aug. 28, 1998

[51] Int. Cl.[7] ..... E04H 1/00

[52] U.S. Cl. ..... 52/169.7; 182/2.3; 182/2.8; 182/130; 182/131; 52/650.3

[58] Field of Search ..... 52/169.7, 650.3; 256/24, 25, 31, 1; 4/494; 14/31, 42; 297/354.13; 182/2.2, 2.3, 2.8, 128, 130, 131

[56] References Cited

U.S. PATENT DOCUMENTS

| | | | |
|---|---|---|---|
| 36,441 | 9/1862 | Skinner | 297/354.13 |
| 3,654,639 | 4/1972 | Lankheet | 4/172.19 |

*Primary Examiner*—Richard Chilcot

*Attorney, Agent, or Firm*—Kirkpatrick & Lockhart LLP

[57] ABSTRACT

A deck assembly. The deck assembly may have at least one nonmovable horizontally-oriented unit and at least one movable unit that pivotally attached to a nonmovable unit. The movable unit can be pivoted between a first position wherein it is substantially co-planar with the nonmovable unit to which it is attached to form a substantially planar deck surface. The movable unit may also be selectively pivoted to at least one position wherein it is not co-planar with the nonmovable unit to form an upstanding fence or barrier. Each movable unit may be fitted with a support brace for supporting the nonmovable unit in the non-coplanar position. The deck units may also be equipped with shock absorbers for controlling the pivotal travel of the movable deck units to a predetermined rate. In addition, the deck units may also be pivoted and retained in any non-coplanar position by fluid actuated air cylinders attached between the nonmovable units and the movable units.

44 Claims, 8 Drawing Sheets

DECK ASSEMBLY

CROSS REFERENCES TO RELATED APPLICATIONS

Not applicable.

FEDERALLY SPONSORED RESEARCH

Not applicable.

BACKGROUND OF THE INVENTION

1. Field of the Invention

The subject invention relates to support platforms and fences and, more particularly, to a deck assembly capable of selectively acting as a deck platform or a safety wall.

2. Description of the Invention Background

Over the years, residential swimming pools have attained widespread acceptance by homeowners due to their convenience and relatively economical installation and operating costs. Such pools may range from permanent in-ground structures constructed from concrete to above-ground prefabricated structures that are fitted with plastic liners and the like for containing water. These pools may be provided in a variety of different shapes, configurations and sizes to suit users' needs.

To increase the pool's utility, many users often build a deck that extends completely around the pool or a portion of the pool. Such decks afford the user a comfortable place for sunbathing, barbecuing, etc. A variety of decks are disclosed in U.S. Pat. No. 3,600,722 to Diemond, U.S. Pat. No. 3,654,639 to Lankheet, U.S. Pat. No. 3,840,908 to Greene, U.S. Pat. No. 3,877,085 to Bukaitz et al. U.S. Pat. No. 4,023,217 to Kessler, U.S. Pat. No. 4,413,361 to Wolf et al., U.S. Pat. No. 4,137,576 to Greene, and U.S. Pat. No. 5,010,603 to Hertzog.

Pool owners must typically also concern themselves with preventing unsupervised access to the pool by young children, animals, etc. In fact, many municipalities have enacted ordinances which require pool owners to provide barriers around the pool to prevent unauthorized access thereto when the pool is otherwise not in use by the owner. Many of the decks disclosed in the above-mentioned patents employ permanent fence structures presumably for that purpose. Some fences comprise a portion of the deck support structure and cannot be removed apart from the deck. Such deck and fence constructions typically require a myriad of different types of fasteners and support braces which can also lead to their complexity and expense. Also, numerous fence arrangements are permanent immovable structures. Therefore, they cannot be moved to provide unimpeded access to the pool during use. They also limit the user's ability to view the pool's surroundings while swimming.

Thus, there is a need for a deck structure that is relatively inexpensive and easy to construct.

There is a further need for a deck structure that has a portion which can be selectively positioned to function as a fence when the pool is not in use.

There is another need for a deck assembly that has the above-mentioned fence arrangement that can be easily moved between an upright position and a horizontal position and secured in such positions without requiring the use of hand tools.

Another need exists for a deck assembly that has the above-mentioned capabilities and that is an aesthetically pleasing construction.

Yet another need exists for a deck and fence assembly that can be adapted for use with above-ground and in-ground swimming pools.

There is still another need for a deck and fence assembly that can be configured to surround the perimeter of a pool or abut only a portion of the pool's perimeter.

Another need exists for a deck assembly having the characteristics described above that can be constructed for use with any size or shape of swimming pool.

There is a further need for a deck assembly that has many of the above-described traits and can be used in a variety of non-swimming pool related applications.

SUMMARY OF THE INVENTION

In accordance with a particularly preferred form of the present invention, there is provided a deck assembly which includes at least one first deck unit and at least one second deck unit that is pivotally attached to at least one first deck unit such that the second deck unit can be pivoted between a first position wherein the second deck unit is substantially coplanar with the first deck units to which it is attached and at least one other position wherein the second deck unit is not coplanar with the first deck units. The deck assembly may further include at least one support for selectively supporting each second deck unit in at least one of the non-coplanar positions.

The subject invention may also comprise a deck for a swimming pool. The deck may include a base assembly that is adjacent to at least a portion of a pool's perimeter. At least one first deck unit may be attached to the base assembly. At least two second deck units are pivotally attached to the base assembly and are selectively pivotable between a first position wherein the second deck units are supported on the base assembly and are substantially co-planar with the first deck units and at least one other position wherein the second deck units are not coplanar with the first deck units. The deck may further comprise a support brace that is engagable with the second deck units and the base assembly to retain the second deck units in at least one of the non-coplanar positions.

When in the down positions, the movable deck units cooperate with the nonmovable units to form an attractive deck surface. When the movable units are pivoted to their non-coplanar positions, they can act as a fence or safety barrier. When used in connection with circular pools, insert boards may be additionally used to complete the barrier. When not in use, the insert boards may be stored under the movable deck units. To assist the user in pivoting the movable units, commercially available cushioning devices may be employed to control the rate at which the movable deck units may be pivoted. If desired, the deck assembly may be equipped with fluid-actuated cylinders for pivoting and retaining the movable deck units in upstanding positions. The subject invention represents an attractive improvement over past deck and fence arrangements. In addition, the subject invention is relatively easy to build and maintain. Accordingly, the invention provides solutions to the shortcomings of other decks and fences, especially in relation to swimming pools. Those of ordinary skill in the art will readily appreciate, however, that these and other details, features and advantages will become further apparent as the following detailed description of the preferred embodiments proceeds.

BRIEF DESCRIPTION OF THE DRAWINGS

In the accompanying Figures, there are shown present preferred embodiments of the invention wherein like reference numerals are employed to designate like parts and wherein.

DETAILED DESCRIPTION OF THE PREFERRED EMBODIMENTS

Figure 1:
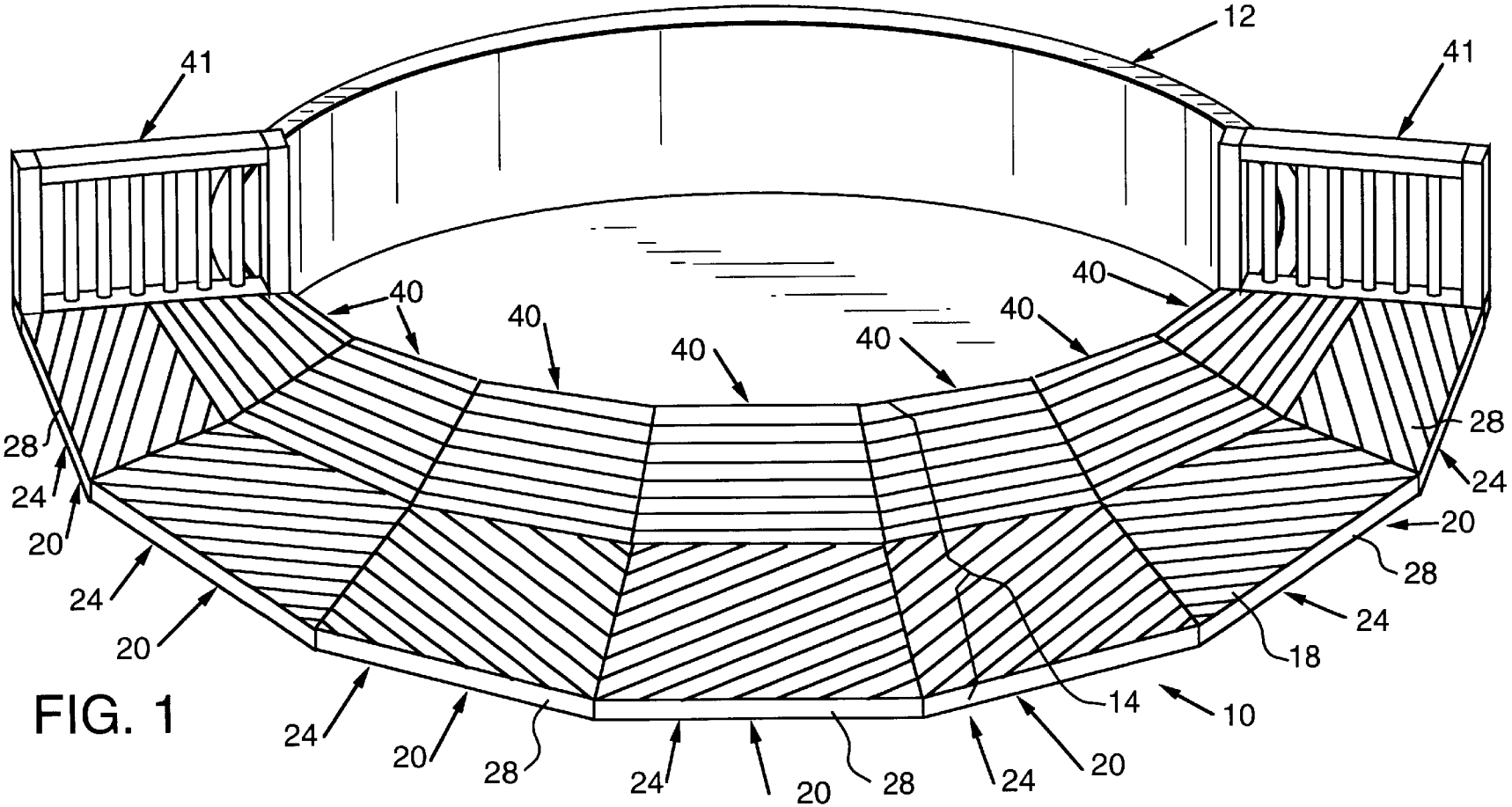
FIG. 1 is a perspective view of a deck assembly of the present invention in a first position adjacent a circular swimming pool.

Referring now to the drawings for the purposes of illustrating the present preferred embodiments of the invention only and not for the purposes of limiting the same, there is illustrated a deck assembly 10 that is used in connection with an above-ground swimming pool 12. Although the deck assembly 10 is disclosed herein in association with a circular-shaped above-ground swimming pool, those of ordinary skill in the art will readily appreciate that the subject invention may be successfully employed in a myriad of differently shaped above-ground and in-ground pools. It will be further appreciated that the subject invention may be advantageously employed in a variety of non-swimming pool related applications wherein it is desirable to have a support platform and a selectively movable fence arrangement. Therefore, the scope of protection afforded to the subject invention should not be limited to use in connection with swimming pools.

Figure 2:
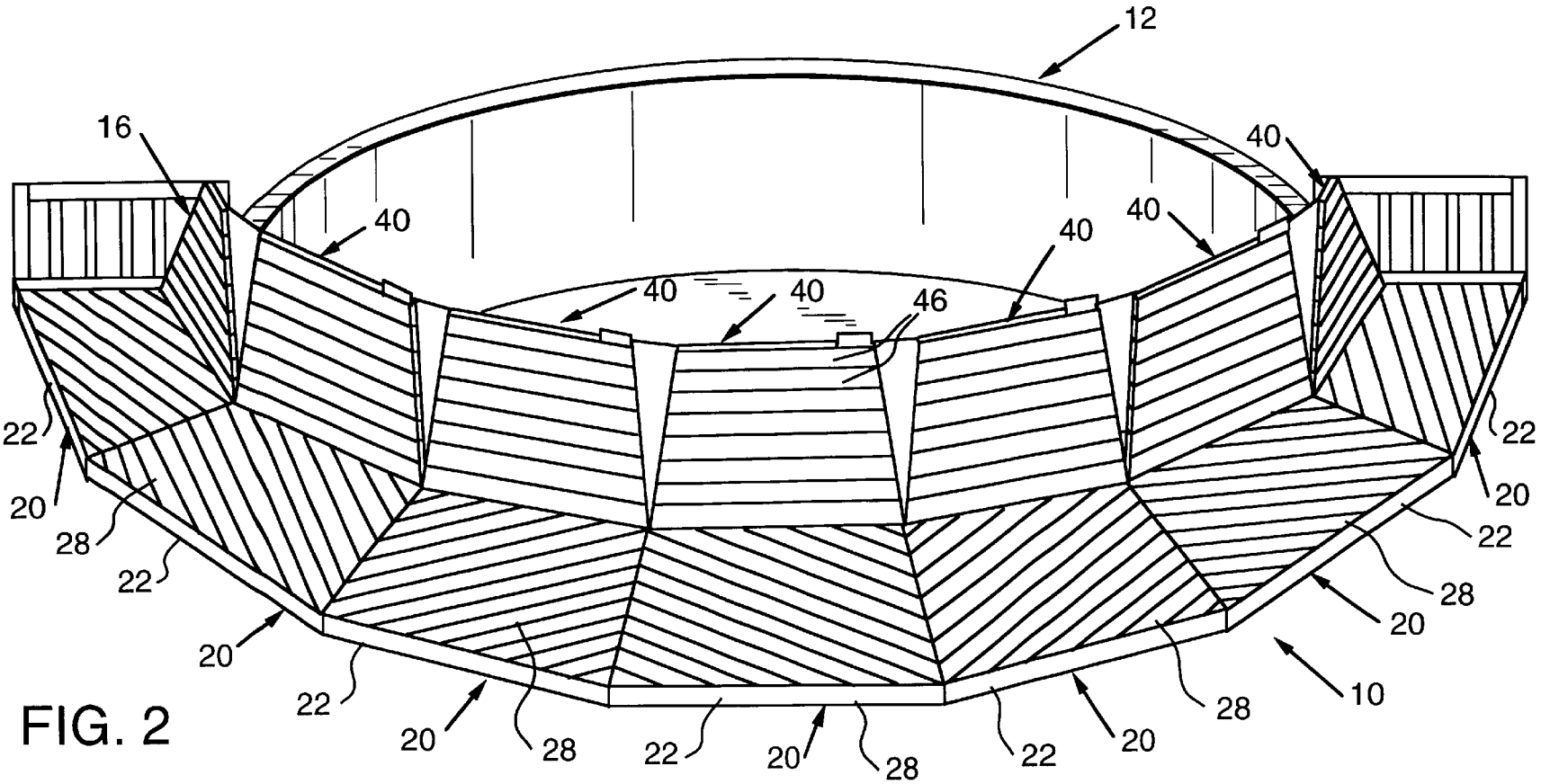
FIG. 2 is a perspective view of the deck assembly of FIG. 1 in a second position.

More specifically and with reference to FIGS. 1 and 2, the deck assembly 10 may be constructed to abut a portion of a circular above-ground swimming pool 12. In a preferred embodiment, the deck 10 may comprise a plurality of nonmovable "first" units 20 and a plurality of movable "second" units 40 that are pivotably attached to the first units 20. As the present detailed description proceeds, the skilled artisan will appreciate that the movable units 40 may be selectively pivoted between first positions wherein the units 40 are substantially coplanar with the non-movable units 20 to form a deck platform having a substantially co-planar or walking surface deck surface generally designated as 14 (FIG. 1) and upright positions to form a safety fence, generally designated as 16 (FIG. 2).

The nonmovable units 20 and the movable units 40 are preferably each fabricated from pressure treated lumber. However, those units may be fabricated from a variety of different materials such as wood, plastic, aluminum, steel, etc. depending upon the specific application and surrounding environmental conditions. Each nonmovable unit 20 may include a frame consisting of a plurality of support joists 22 that are attached together by appropriate fasteners such as screws, nails, etc. to form a rigid base 24 and a plurality of deck boards 28 that are attached to the base 24 by screws, nails etc. Appropriately sized posts 26 and braces may be employed to support the bases 24 above the ground level 18. It will be appreciated that the nonmovable units 20 may also be supported on the ground 18 for in-ground pool installations and even with above-ground pool applications that have the grade adjacent a portion of the pool. Other applications may also dictate that the nonmovable units 20 be supported on the ground level 18. In such installations, to assist with leveling the units 20 relative to the top or side of the pool, the ground may be excavated to receive gravel, sand, etc. that can be leveled to support the bases 24 thereon.

In the embodiment depicted in FIGS. 1 and 2, the nonmovable units 20 are configured to extend around approximately one half of the perimeter of pool 12. The skilled artisan will appreciate that, if desired, the units 20 may be constructed to extend completely around the perimeter of the pool 12. It will be further appreciated that the portion of the deck 10 that is formed from the deck units 20 may be fabricated in one integral piece. In the embodiment depicted in FIGS. 1 and 2, the decking boards 28 of one unit 20 are attached to their corresponding base 24 in an angular orientation that differs from the angular orientation of the decking boards 28 of adjacent units 20. The reader will understand, however that the decking boards 28 of the units 20 may be arranged in any desirable pattern.

Also in this embodiment, to support the movable units 40 when in the down position (FIG. 1), a support base assembly 42 is preferably provided adjacent the pool 12. See FIG. 3. Base assembly 42 may also be fabricated from pressure treated joists 44 that are interconnected to form a frame-like support structure. In the embodiment depicted in FIG. 3, a portion of the base assembly 42 is supported on the edge of the pool 12 and is supported above the ground 18 by appropriately sized posts 26. Those of ordinary skill in the art will appreciate that the frame assembly 42 may be arranged adjacent to the pool 12 and be attached thereto by appropriate means if so desired. Also, for in-ground pools and the like, the base assembly 42 may be supported on the ground 18.

Figure 9:
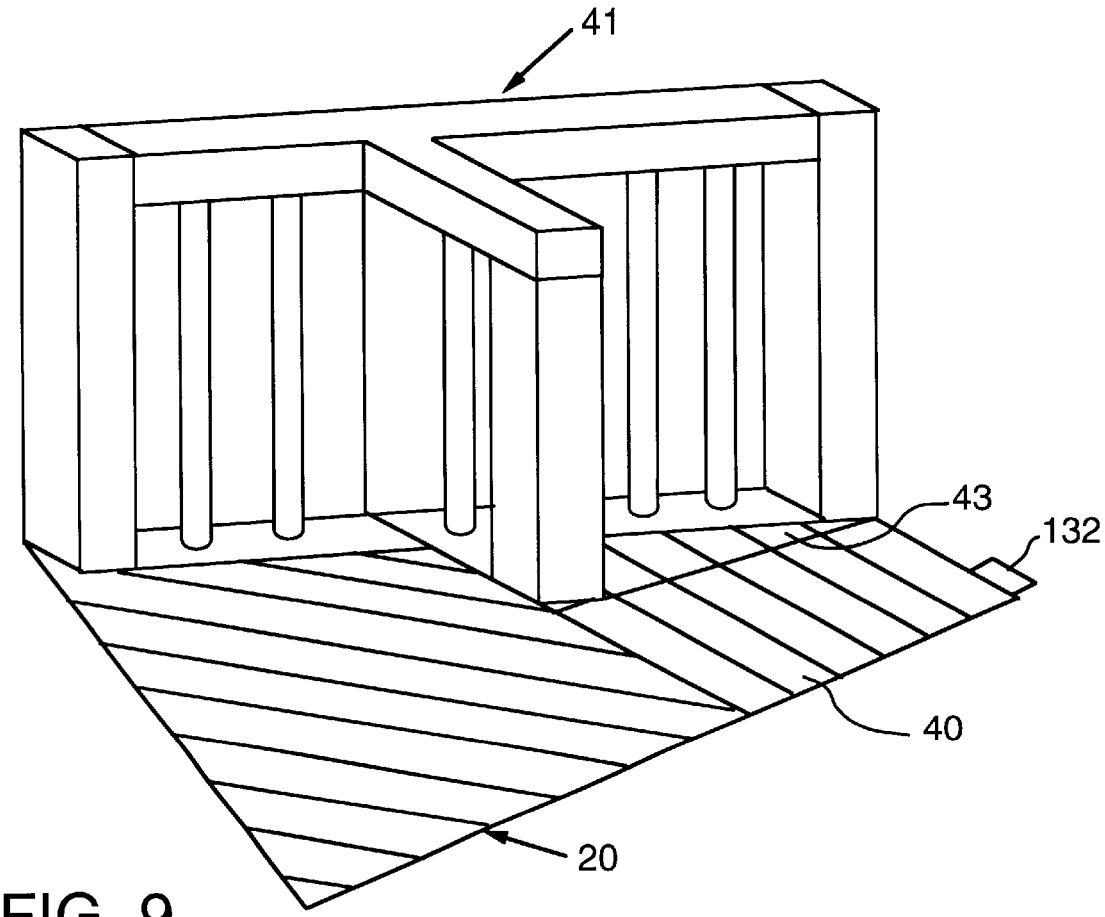
FIG. 9 is a partial perspective view of a safety rail arrangement that may be employed at the ends of the deck assembly.

As can be seen in FIGS. 2–6, a preferred unit 40 comprises a plurality of decking boards 46 that are fastened to a collection of deck braces 46 by screws, nails, etc. In a preferred embodiment, the movable units 40 (and the corresponding nonmovable units 20) may be made slightly smaller than the other units (20, 40). By making those units slightly smaller, the moveable units 40 are more easily pivoted to their respective upright positions because they are lighter than the other movable units 40. Also, a safety railing 41 may be constructed on each end to further limit access to the pool 12 or other object when the movable members are their respective upright positions. As can be seen in FIG. 9, the safety railing 41 may be fabricated in a T-shape and employ a small nonmovable triangularly-shaped portion 43 to support one end thereof. In this embodiment, the end unit 40 is preferably smaller than the other movable units 40 which can make that unit easier to pivot to an upright position in the manners that will be discussed in further detail below.

Figure 3:
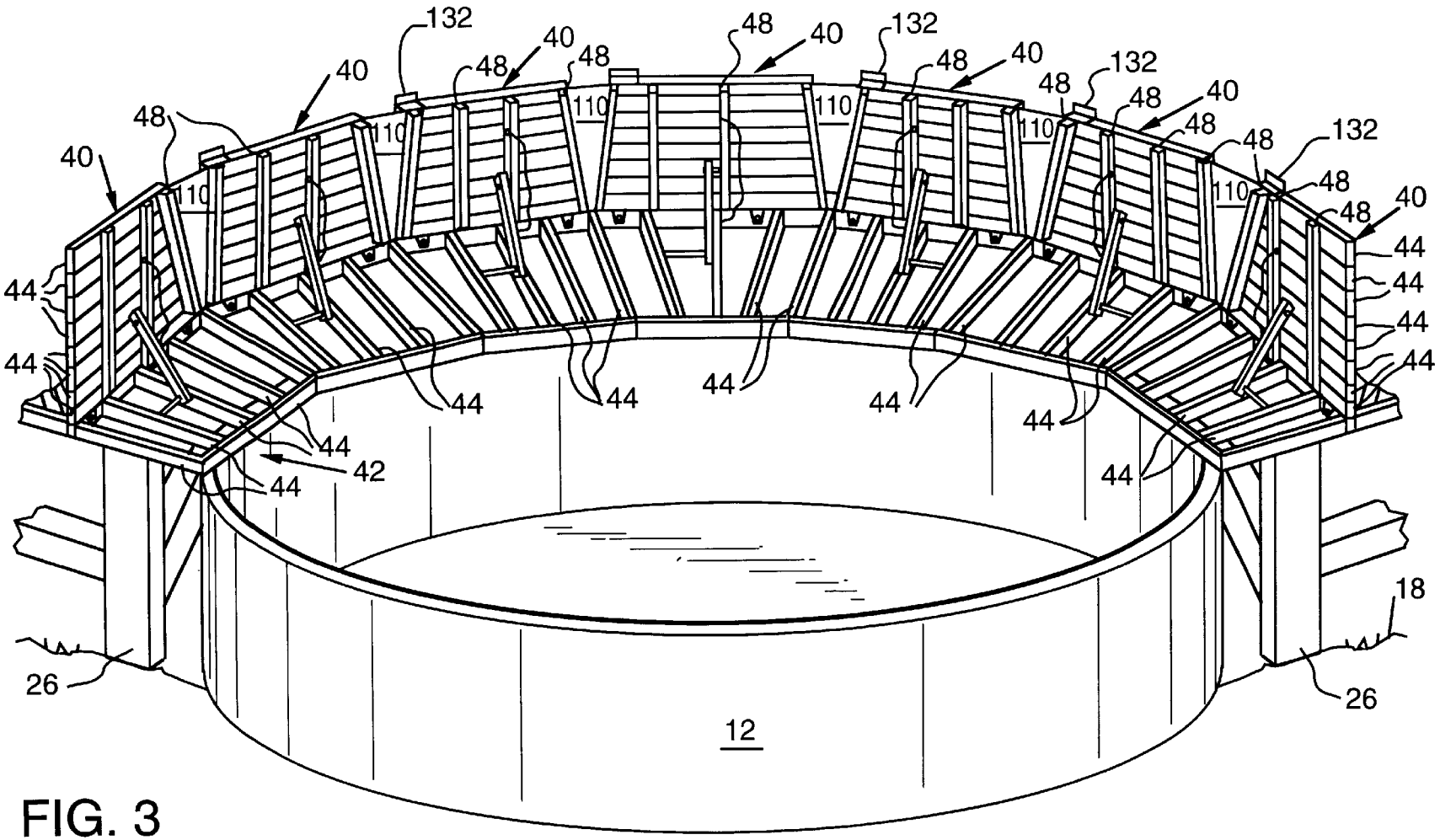
FIG. 3 is another perspective view of the deck assembly of FIG. 2 without the end railings attached thereto.
Figure 7:
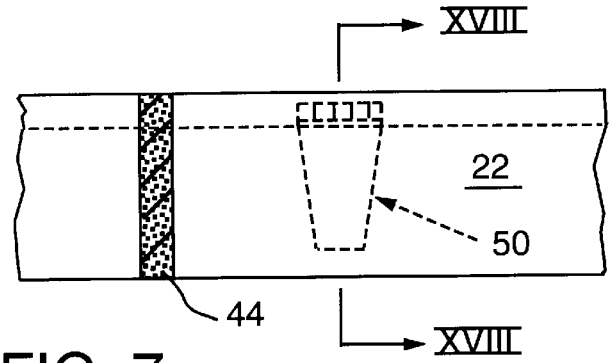
FIG. 7 is a partial side view of hinge arrangement for attaching a movable unit to a support joist.
Figure 8:
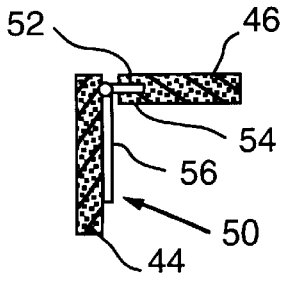
FIG. 8 is a partial cross-sectional view of the hinge and joist of FIG. 7, taken along line XVIII—XVIII of FIG. 7.

To enable a safety fence to be formed around the circular pool 12, in a preferred embodiment, the decking boards 46 are cut such that when the units 40 are in the upright positions shown in FIGS. 2 and 3, an angle of approximately 22.5° (represented by arrow "A" in FIG. 5) is formed between the units 40. However, units (20, 40) may be provided in other suitable shapes and configurations. As will be discussed in further detail below, removable insert members 110 are preferably employed to complete the fence structure. To facilitate pivotal travel of the units 40 relative to the non-movable units 20, each unit 40 is preferably pivotally attached to a corresponding non-movable unit 20 by at least one, and preferably two, commercially available hinges 50. See FIGS. 4, 7 and 8. As can be seen in those Figures, one hinge portion 52 is preferably received in a slot 54 provided in a corresponding decking board 46 and is affixed thereto by screws that extend through the upper surface of the decking board 46 and through holes in the hinge portion 52. The other hinge portion 56 is affixed to a corresponding joist 22 by appropriate fasteners such as screws. As can be most particularly seen in FIG. 8, the pivot barrel 50 of the hinge 50 (i.e., the part of the hinge 50 wherein the portions 52 and 56 are pivotally attached to each other) is located below the upper surface of the decking boards 28 and 46. The skilled artisan will appreciate that such unique and novel arrangement prevents the hinge 50 from protruding above the deck boards 28 when the deck units 40 are in their respective down positions. Thus, by mounting the hinges 50 in such a manner, a potential tripping hazard caused by the hinges 50 protruding above the deck boards 28 and 46 is avoided.

Figure 4:
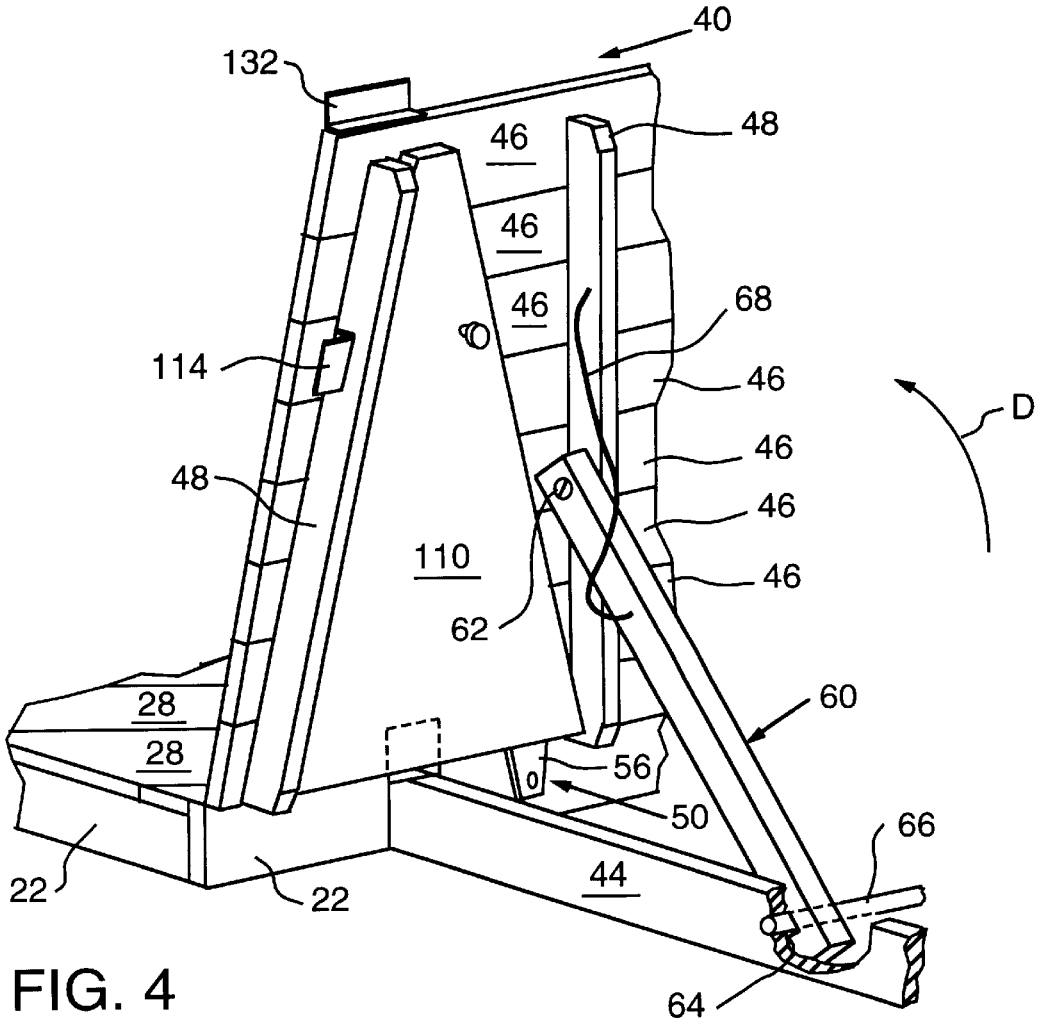
FIG. 4 is a partial perspective view of a movable deck unit of the present invention in an upright position and showing an insert board in a storage position.
Figure 5:
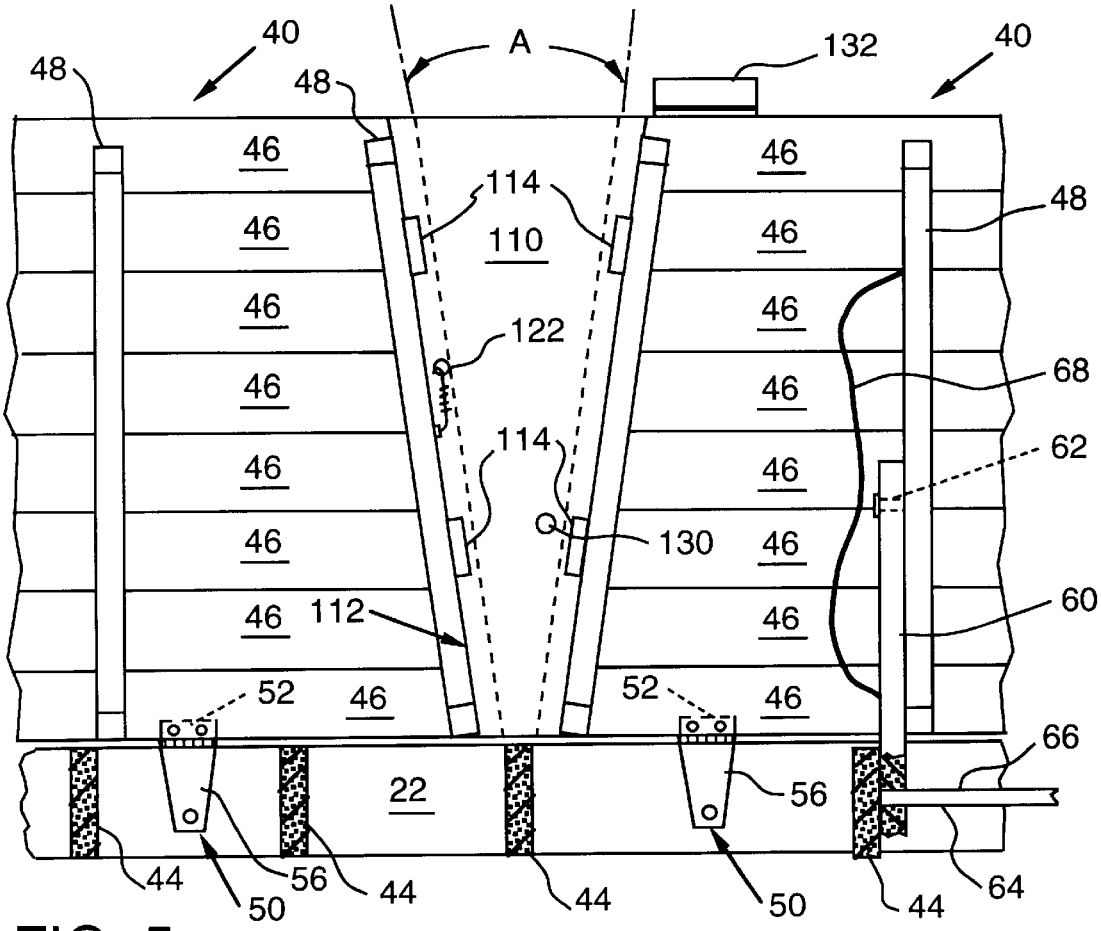
FIG. 5 is a partial elevational view of two movable deck units in upright adjacent positions with an insert board installed therebetween.

In a preferred embodiment, at least one support brace 60 is employed to retain a corresponding movable deck unit 40 in an upright position (i.e. in a position wherein the deck unit 40 is not co-planar with its corresponding deck unit 20). As shown in FIGS. 4 and 5, the support brace 60 may comprise a piece of pressure treated lumber or other suitable material that is pivotally attached on one end to a corresponding deck brace 48 of a deck unit 40. The support brace 60 may be pivotally attached to the deck brace 48 by a bolt 62 or other suitable fastener arrangement. The other end of the support brace 60 preferably has at least one notched portion 64 that is adapted to selectively engage a threaded engagement rod 66, pipe, dowel, etc. that is attached to a joist 44. When the rod 66 is received within the notched portion 64, the corresponding movable unit 40 will be preferably supported in a non-planar position relative to the non-movable deck units 20. Those of ordinary skill in the art will appreciate that the relative angular position of each deck unit 40 to its corresponding deck unit 20, can be adjusted by providing a plurality of notches 64 in the support brace 60. In addition, a pull cord 68 may be attached at one end to the corresponding deck brace 48 and at its other end to the support brace 60 to enable a user standing on a corresponding non-movable deck unit 20 to pull the support brace 60 out of engagement with its corresponding rod 64 to permit the deck unit 40 to pivot to a down position. The skilled artisan will appreciate that when in the down position, the support brace 60 is received under the deck boards 46.

Also in a preferred embodiment, a lift support assembly 70 may be additionally employed to permit each movable deck unit 40 to be easily raised and lowered in a controlled manner. More particularly and with reference to FIGS. 10 and 11, a commercially available charged lift support 72 such as the one manufactured by Pro Lift and distributed by R&B Inc. of 3111 West Allegheny Avenue, Philadelphia, Pa. 19132 under Model No. RB8795080 may be used. However, other shock absorber and spring arrangements may be successfully used. Those of ordinary skill in the art will understand that such lift support 72 comprises a cylinder housing 74 that slidably supports a piston rod 76 therein. One end 78 of the piston rod 76 is preferably pivotally attached to the decking boards 46 of a corresponding movable deck unit 40. To facilitate such pivotal attachment, an attachment block 80 may be affixed to the bottom of the movable deck unit 40 by, for example, appropriately sized screws. The end 78 of the pivot rod 76 preferably has an eye (not shown) formed thereon to enable a bolt 82 to extend therethrough. To facilitate unimpeded travel of the rod end 78 about the bolt 82 along axis B—B, a cavity 84 is provided in the attachment block 80. The cylinder housing 74 is then pivotally attached to a corresponding joist 44. Although the housing 74 may be attached to the joist 44 in a variety of different manners, the present invention employs a novel arrangement that affords additional protection to the housing 74 during operation.

Figure 11:
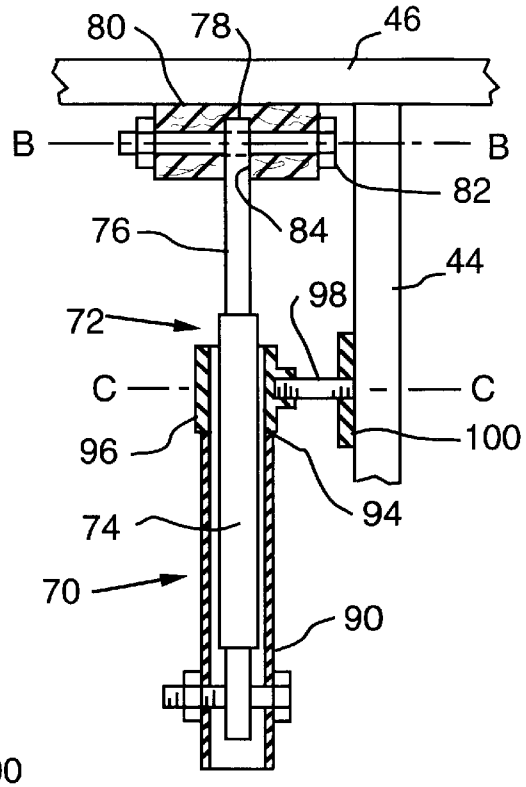
FIG. 11 is a partial cross-sectional view of a shock assembly of the present invention.
Figure 10:
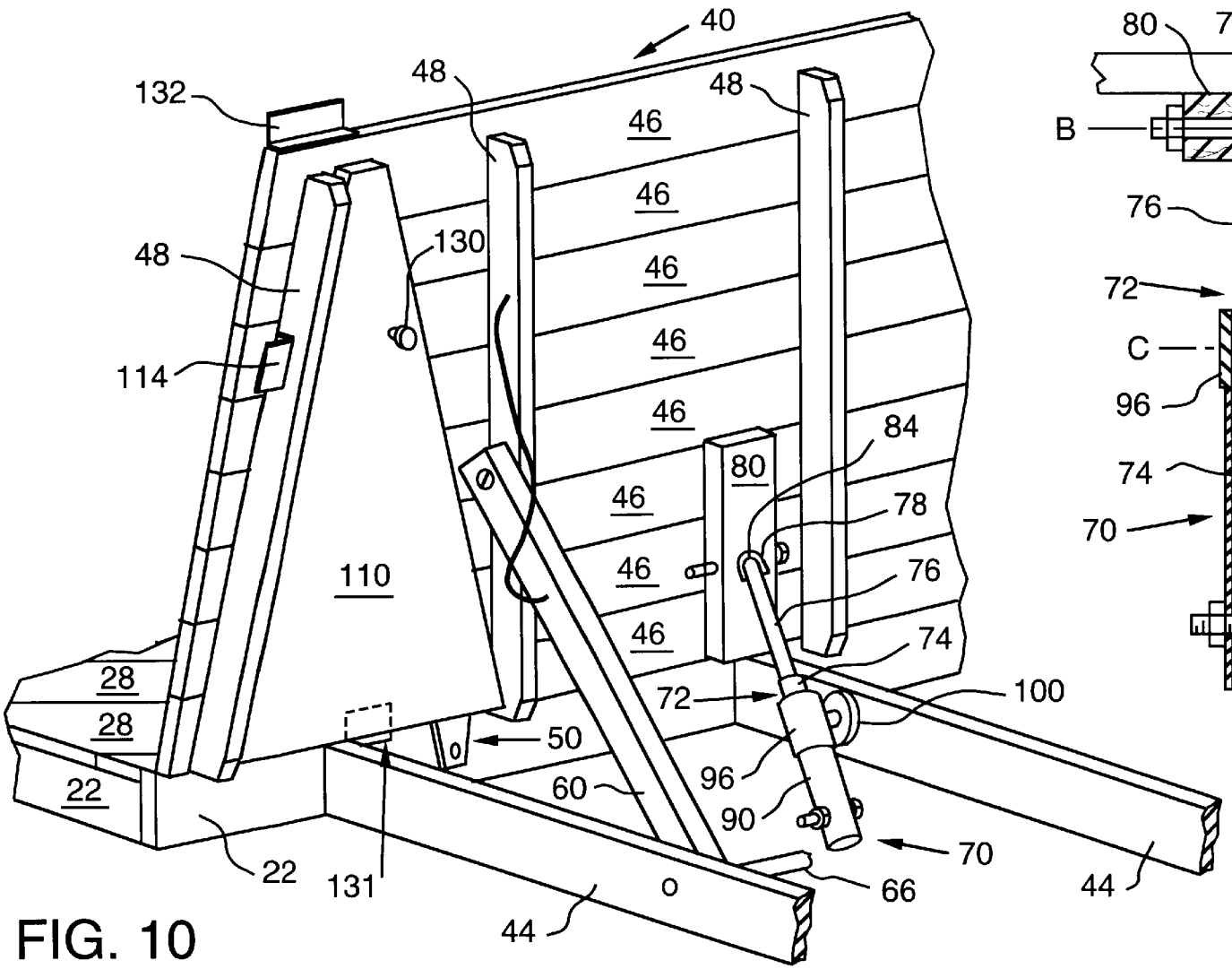
FIG. 10 is a partial perspective view of another embodiment of the present invention illustrating a preferred shock assembly of the present invention.

As can be seen in FIGS. 10 and 11, the cylinder housing 74 is preferably pivotally pinned within a hollow pipe segment 90. Housing 74 preferably has a mounting hole that can receive a mounting bolt 92 therethrough. Pipe segment 90 preferably has a threaded end 94 that is adapted to be attached to a commercially available pipe Tee 96. A threaded nipple 98 is attached to the Tee 96 and a threaded attachment flange 100 attached to a corresponding joist 44. The skilled artisan will appreciate that such arrangement enables the pipe segment 90 to pivot about axis C—C. See FIG. 11. Thus, as the corresponding deck unit 40 is pivoted to the up position, the lift support member 70 controls the speed at which it is pivoted. Likewise, when the deck unit 40 is pivoted to a down position, its rate of pivotal travel is controlled to prevent the unit 40 from slamming into the base assembly 42 which could result in inadvertent damage to the deck unit 40 and/or base assembly 42 and also possibly injure the user. It will be further appreciated that lift support members may comprise fluid-actuated cylinders that can be used to selectively retain the movable deck units 40 in their respective upright positions such that the support braces 60 would not be required.

Figure 6:
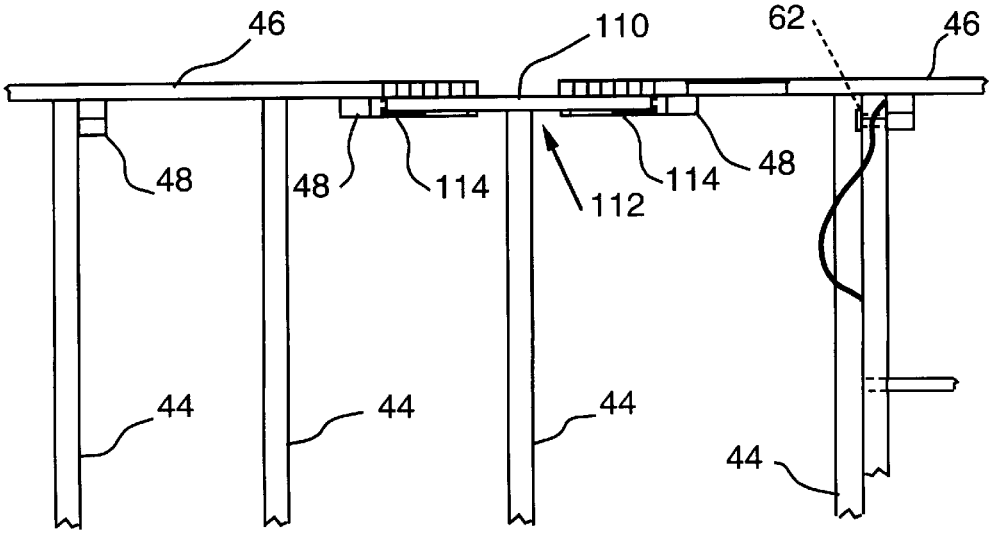
FIG. 6 is a top view of the deck units of FIG. 5.

In this embodiment of the present invention, insert boards 110 are employed to complete the safety fence when the deck units 40 are in their respective upright positions. Those of ordinary skill in the art will appreciate that, if it is desired to form a complete upright barrier or safety fence around at least a portion of a circular pool or other object, such boards 110 can be advantageously employed between the respective deck units 40. In a preferred embodiment, the insert boards 110 are complementary shaped to span the angular space between two corresponding deck units 40. In addition, to create a wedge-like fit between the insert board 110 and its corresponding deck units 40, a deck brace 48 is affixed to each corresponding deck unit 40 to define a V-shaped opening 112 between the deck units 40. The insert board 110 is complementary shaped to be wedgingly received between the deck braces 48 as shown in FIG. 5. To facilitate slidable support of the insert boards 110 between the deck braces 48, at least one, and preferably four, aluminum channels 114 are affixed to the inside of each deck unit 40 as shown in FIGS. 4–6. The C-shaped channels 114 may be fabricated from a variety of different materials such as aluminum, steel, plastic etc. and are sized to slidably receive therein a corresponding insert board. As shown in FIGS. 5 and 6, the wedge-shaped insert boards are sized to be received within the inside surfaces of the corresponding deck units 40 such that the side edges of the deck units 40 overlap the side edges of the insert board 110. Also, to retain the insert board 110 in position, a commercially available spring-biased hook 120 such as those hooks manufactured by National Mfg. Company of Sterling, Ill. 61081 under Model No. N170-746 V2002 may be employed. In particular, one end of the hook 120 is preferably screwed into one of the deck braces 48 and the hook portion thereof is adapted to selectively engage a screw eye or hole 122 in the insert board. Thus, the hook arrangement 120 biases the insert board into wedging engagement with the deck braces 48. When not in use, the insert boards 110 may be affixed in an inverted position to the underside of the movable deck unit 40 by a commercially available thumb screw 130. The insert board 110 may also be supported by a channel or angle 131, preferably fabricated from aluminum and attached to the bottom of a corresponding movable unit 40. See FIG. 10.

The use of the present invention will now be described. FIG. 1 illustrates the movable deck units 40 in their respective down positions. When in those positions, the movable deck units 40 cooperate with the non-movable deck units 20 to form a substantially co-planar deck surface 14. When in such position, the user has unimpeded viewing and access to the pool or other adjacent object. When it is desired to form the safety fence, the user pivots each movable deck unit 40 to its upright position and then engages its corresponding support brace 60. In a embodiment wherein the movable units 40 on the ends of the deck assembly 10 are smaller than the other movable units 40, one of the end units is pivoted to its upright portion first. This may be accomplished by a rope or chain attached to that end unit. To enable the user to easily grasp the adjacent deck unit 40, an angle-shaped member 132 may be affixed to the top of the deck unit 40 as shown in FIG. 4. The angle 132 may be fabricated from aluminum steel, plastic etc. and serves as a handle. Thus, the user grasps the angle 132 and pivots the deck unit in the "D" direction (see FIG. 4). As the unit 40 is pivoted in the "D" direction, its corresponding support brace 60 slides on the engagement rod 66 until the notch 64 in the support brace 60 engages the rod 66 to retain the deck unit 40 in its upright position. The other deck units 40 are similarly positioned. Thereafter, the corresponding insert boards 110 are removed from the underside of the deck units 40 and are slidably inserted between their corresponding deck units 40. After they have been inserted into the channels 114 and slid into position as shown in FIG. 5, the spring biased hook 120 is engaged with the hole 122 the insert board 110 to retain the insert board 110 in position. Each insert board 110 is installed in that manner. To return the deck 10 to its down position as shown in FIG. 1, the hooks 120 are unlatched and the insert boards 110 are removed and stored as shown in FIG. 4. Thereafter, the user can disengaged each support brace 60 by grasping its cord 68 and pulling it out of engagement with its respective retaining rod 66. The shock assembly 70 then controls the rate at which deck unit 40 pivotally descends back to its down position.

Figure 12:
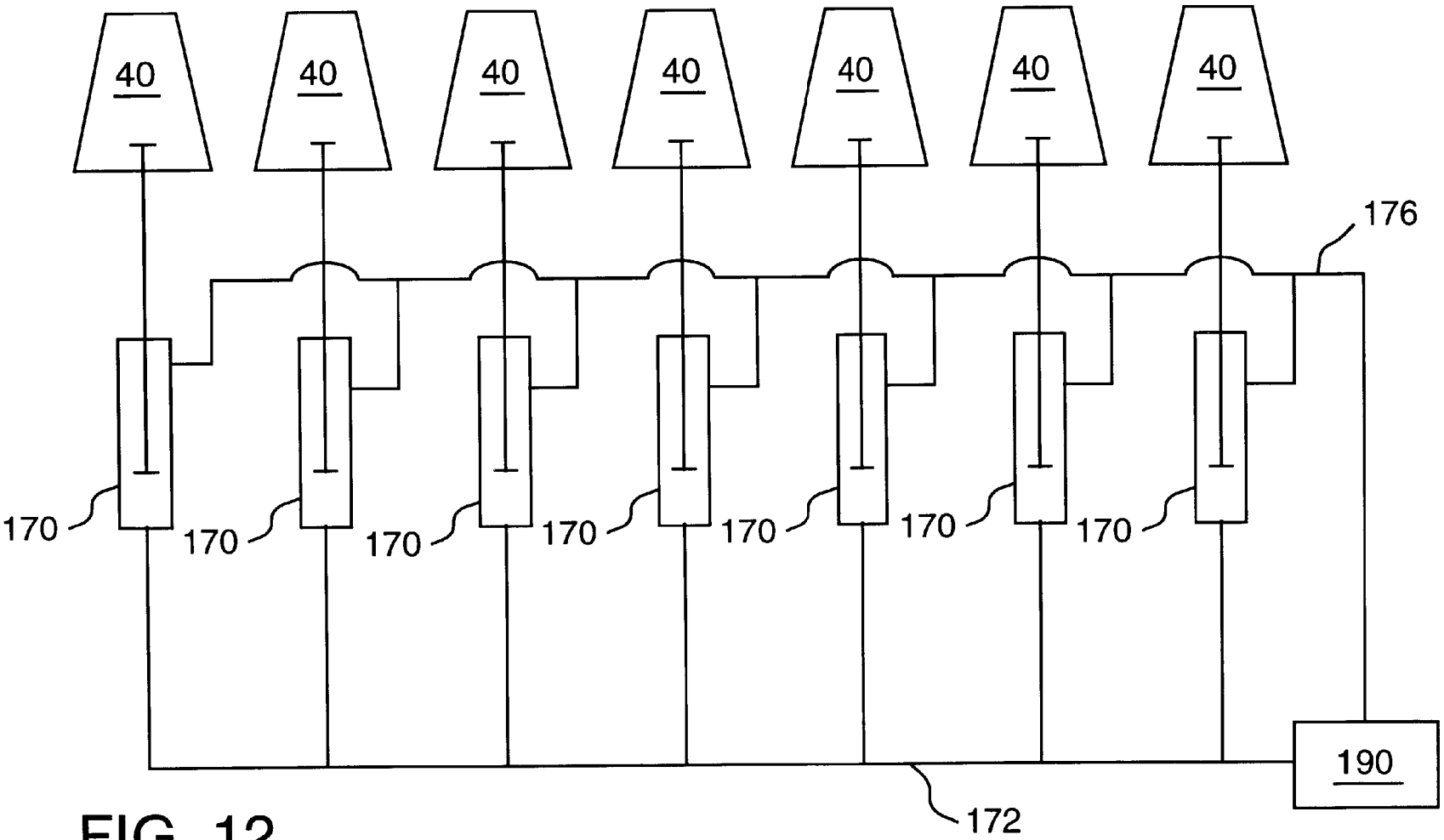
FIG. 12 is a schematic view of another embodiment of the present invention that employs fluid-actuated cylinders to raise and lower the movable deck units.

In another embodiment, depicted in FIG. 12, the deck units 40 may be simultaneously pivoted to their upright positions and also simultaneously returned to their down positions. In this embodiment, the shock assemblies 70 are replaced fluid-actuated (air, hydraulic fluid, etc.) cylinders 170 that are piped to a supply manifold 172 that is connected to a source 190 of pressurized air or hydraulic fluid. The cylinders 170 may be equipped with a spring return such that after the pressurized fluid is discontinued from the cylinders 170, the spring in each cylinder 170 retracts the piston therein to return the corresponding deck unit 40 to is down position. The skilled artisan will appreciate that by selectively controlling the venting of fluid or air from the cylinders 170 through a return manifold 176, the deck units 40 can be pivoted to the down position in a controlled manner. In the alternative, pressurized fluid (i.e., air, hydraulic fluid, etc.) may be selectively supplied on each side of the cylinder's piston to control the extension and retraction of the piston rod. Thus, such arrangement enables the deck units to be automatically and substantially simultaneously moved between their respective upright and down positions.

The present invention presents a vast improvement over past deck and fencing arrangements. The present deck assembly is aesthetically pleasing and can selectively function as a deck and a safety fence or barrier around pools and other structures. While the deck assembly has been described herein as including a plurality of movable deck units, the ultimate number of deck units may be dictated by the size and shape of the pool or other adjacent structure. Thus, it is conceivable that only one movable deck unit may be required. It is further conceivable that such deck structures may not require the use of insert boards or require the use of insert boards that are differently shaped. The skilled artisan will further appreciate that permanent benches, etc. may be added to the nonmovable portion of the deck assembly if so desired. Also, railings may be installed on deck assemblies to further limit unauthorized access, depending upon the shape and configuration of the pool or other adjacent object. Those of ordinary skill in the art will appreciate that the subject invention can be advantageously used in connection prefabricated and existing deck arrangements. For above-ground installations, an enclosed storage area may also be formed under the deck assembly. Thus, from the foregoing discussion, it is apparent that the present invention solves many of the problems encountered by past deck arrangements. Those of ordinary skill in the art will, of course, appreciate that various changes in details, materials and arrangement of parts which have been herein described and illustrated in order to explain the nature of the invention may be made by the skilled artisan within the principle and scope of the invention as expressed in the appended claims.

What is claimed is:

1. A deck assembly, comprising:

at least one first deck unit;

at least one second deck unit pivotally attached to said at least one first deck unit such that said at least one second deck unit can be pivoted between a coplanar position wherein said at least one second deck unit is substantially coplanar with said at least one first deck unit to which it is attached to form a coplanar walking surface and at least one non-coplanar position wherein said at least one second deck unit is not coplanar with said at least one first deck unit to which it is attached; and at least one support for selectively supporting said at least one second deck unit in said at least one said non-coplanar position.

2. The deck assembly of claim 1 wherein each said support comprises a brace pivotally attached to each said at least one second deck unit and configured to selectively engage an engagement member affixed to said at least one first deck unit to which said at least one second deck unit is attached.

3. The deck assembly of claim 1 wherein said support comprises at least one fluid-actuated cylinder attached to said at least one second deck unit and said at least one first deck unit to which said at least one second deck unit is attached.

4. The deck assembly of claim 1 wherein two said at least one second deck units are adjacent to each other and wherein said deck assembly further comprises an insert member attachable to said two said at least one second deck units that are adjacent to each other and extending therebetween when said two said at least one second deck units that are adjacent to each other are in a common said at least one non-coplanar position.

5. The deck assembly of claim 4 wherein said two said at least one second deck units that are adjacent to each other define a substantially V-shaped opening therebetween when said two said at least one second deck units that are adjacent to each other are in said common said at least one non-coplanar position and wherein said insert member is substantially V-shaped for wedging engagement with said two said at least one second deck units that are adjacent to each other when said two said at least one second deck units that are adjacent to each other are in said common said at least one non-coplanar position.

6. The deck assembly of claim 5 further comprising a retainer attached to at least one of said two said at least one second deck units that are adjacent to each other to selectively retain said insert member in said wedging engagement with said two said at least one second deck units that are adjacent each other when said two said at least one second deck units that are adjacent each other are in said common said at least one non-coplanar position.

7. The deck assembly of claim 1 further comprising at least one shock member attached to said at least one second deck unit and said at least one first deck unit to which said at least one second deck unit is attached to establish a predetermined rate at which said at least one second deck unit can pivot relative to said at least one first deck unit.

8. The deck assembly of claim 1 wherein said at least one second deck unit is pivotally attached to said at least one first deck unit by at least one hinge that does not protrude above said walking surface.

9. The deck assembly of claim 4 further comprising a storage retainer for affixing said insert member to said at least one second deck unit when said at least one second deck unit is in said coplanar position.

10. The deck assembly of claim 1 further comprising at least one railing attached to said at least one first deck unit.

11. A deck for a swimming pool, said deck comprising:

a base assembly adjacent at least a portion of a perimeter of the swimming pool;

a first deck unit attached to said base assembly;

two second deck units pivotally attached to said base assembly and being selectively pivotable between a coplanar position wherein said two second deck units are supported on said base assembly and substantially co-planar with said first deck unit and at least one non-coplanar position wherein said two second deck units are not coplanar with said first deck unit; and a support brace corresponding to each one of said two said second deck units and attached to said base assembly to selectively retain said corresponding one of said two second deck units in said at least one non-coplanar position.

12. The deck of claim 11 wherein said a support brace is attached to said corresponding one of said two second deck units and is configured to selectively engage a support member affixed to said base assembly.

13. The deck of claim 11 wherein said support brace comprises at least one fluid-actuated cylinder attached to said corresponding one of said two second deck units and said base assembly.

14. The deck of claim 11 wherein said two second deck units are adjacent each other and wherein said deck further comprises an insert member attachable to said two second deck units that are adjacent to each other and extending therebetween when said two second deck units that are adjacent each other are in a common said at least one non-coplanar position.

15. The deck of claim 14 wherein said two second deck units that are adjacent each other define a substantially V-shaped opening therebetween when said two second deck units that are adjacent to each other are in said common said at least one non-coplanar position and wherein said insert member is substantially V-shaped for wedging engagement with said two second deck units that are adjacent each other when said two second deck units that are adjacent each other are in said common said at least one non-coplanar position.

16. The deck of claim 15 further comprising a retainer attached to at least one of said two second deck units that are adjacent to each other to selectively retain said insert member in said wedging engagement with said two second deck units that are adjacent to each other when in said common said at least one non-coplanar position.

17. The deck of claim 16 wherein said retainer comprises a spring braced hook member.

18. The deck of claim 11 further comprising at least one shock member attached to said base assembly and a corresponding one of said two second deck units to establish a predetermined rate at which said corresponding one of said two second deck units can pivot relative to said base assembly.

19. The deck of claim 11 wherein said first deck unit and said two second deck units form a substantially coplanar deck surface when said two second deck units are in said coplanar position and wherein each said two second deck units are pivotally attached to said base assembly by at least one hinge that does not protrude above said deck surface.

20. The deck of claim 14 further comprising a storage retainer for affixing said insert member to one of said two second deck units when at least one of said two second deck units is in said coplanar position.

21. The deck of claim 11 wherein said first deck unit and each of said two second deck units are fabricated from wood.

22. The deck of claim 11 wherein each of said two second deck units has a handle attached thereto.

23. The deck of claim 12 wherein each said support brace has a cord attached thereto to enable said support brace to be manipulated between engaged and disengaged positions.

24. The deck of claim 11 further comprising at least one fluid-actuated cylinder attached to each of said two second deck units and said base assembly for selectively simultaneously pivoting said two second deck units between said coplanar and said at least one non-coplanar position.

25. The deck of claim 11 further comprising at least one railing attached to said first deck unit.

26. A deck assembly, comprising:

a first deck;

a first deck unit pivotally attached to the first deck and being selectively pivotable between a first position wherein said first deck unit is substantially coplanar with said first deck to form a coplanar walking surface and another upright position; and a second deck unit pivotally attached to said first deck and being selectively pivotable between a second position wherein said second deck unit is substantially coplanar with said walking surface and at least one other second upright position.

27. The deck assembly of claim 26 further comprising a third deck unit pivotally attached to said first deck and being selectively pivotable between a third position wherein said third deck unit is substantially coplanar with said walking surface and at least one other third upright position.

28. The deck assembly of claim 27 further comprising a fourth deck unit pivotally attached to said first deck and being selectively pivotable between a fourth position wherein said fourth deck unit is substantially coplanar with said walking surface and at least one other fourth upright position.

29. The deck assembly of claim 28 further comprising a fifth deck unit pivotally attached to said first deck and being selectively pivotable between a fifth position wherein said fifth deck unit is substantially coplanar with said walking surface and at least one other fifth upright position.

30. The deck assembly of claim 29 further comprising a sixth deck unit pivotally attached to said first deck and being selectively pivotable between a sixth position wherein said sixth deck unit is substantially coplanar with said walking surface and at least one other sixth upright position.

31. The deck assembly of claim 30 further comprising a seventh deck unit pivotally attached to said first deck and being selectively pivotable between a seventh position wherein said seventh deck unit is substantially coplanar with said walking surface and at least one other upright seventh position.

32. The deck assembly of claim 31, further comprising a first insert between said first deck unit and said second deck unit when said first deck unit is in said another first upright position and said second deck unit is in said another second upright position.

33. The deck assembly of claim 32, further comprising a second insert between said second deck unit and said third deck unit when said second deck unit is in said another second upright position and said third deck unit is in said another third upright position.

34. The deck assembly of claim 33, further comprising a third insert between said third deck unit and said fourth deck unit when said third deck unit is in said another third upright position and said fourth deck unit is in said another fourth upright position.

35. The deck assembly of claim 34, further comprising a fourth insert between said fourth deck unit and said fifth deck unit when said fourth deck unit is in said another fourth upright position and said fifth deck unit is in said another fifth upright position.

36. The deck assembly of claim 35, further comprising a fifth insert between said fifth deck unit and said sixth deck unit when said fifth deck unit is in said another fifth upright position and said sixth deck unit is in said another sixth upright position.

37. The deck assembly of claim 36, further comprising a sixth insert between said sixth deck unit and said seventh deck unit when said sixth deck unit is in said another sixth upright position and seventh deck unit is in said another seventh upright position.

38. The deck assembly of claim 26 wherein said first deck is formed around at least a portion of a perimeter of a swimming pool.

39. The deck assembly of claim of claim 31 wherein said first deck is formed around at least a portion of a perimeter of a swimming pool and wherein said first deck unit, said second deck unit, said third deck unit, said fourth deck unit, said fifth deck unit, said sixth deck unit, and said seventh deck unit cooperate to form an upright barrier around said at least a portion of said perimeter of said swimming pool when said first deck unit is in said another first upright position, said second deck unit is in said another second upright position, said third deck unit is in said another third upright position, said fourth deck unit is in said another fourth upright position, said fifth deck unit is in said another fifth upright position, said sixth deck unit is in said another sixth upright position, and said seventh deck unit is in said another seventh upright position.

40. The deck of claim 31 wherein at least one of said first deck unit, said second deck unit, said third deck unit, said fourth deck unit, said fifth deck unit, said sixth deck unit, and said seventh deck unit is pivotally supported relative to said first deck by a corresponding fluid actuated cylinder.

41. The deck unit of claim 31 wherein at least two deck units selected from the group of said first deck unit, said second deck unit, said third deck unit, said fourth deck unit, said fifth deck unit, said sixth deck unit, and said seventh deck unit are pivotally supported relative to said first deck by a corresponding fluid-actuated cylinder.

42. A method of constructing a swimming pool deck, comprising:

constructing a first deck around at least a portion of a perimeter of the swimming pool;

pivotally attaching a first deck unit to the first deck such that the first deck unit is selectively pivotable between a first position wherein the first deck unit is substantially coplanar with the first deck and another first upright position; and providing a retainer member for selectively retaining the first deck unit in the another first upright position.

43. The method of claim 42 further comprising:

pivotally attaching a second deck unit to the first deck adjacent the first deck unit such that the second deck unit is selectively pivotable between a second position wherein said second deck unit is substantially coplanar with the first deck and another second upright position; and providing a second retainer for selectively retaining the second deck unit in the another second upright position.

44. The method of claim 43 further comprising:

retaining the first deck unit in the another first upright position;

retaining the second deck unit in the another second upright position; and installing an insert between the first and second deck units such that the first and second deck units and insert cooperate to form an upright barrier.

* * * * *

UNITED STATES PATENT AND TRADEMARK OFFICE

CERTIFICATE OF CORRECTION

PATENT NO. : 6,098,352
DATED : August 8, 2000
INVENTOR(S) : Louis W. Coffen

It is certified that error appears in the above-identified patent and that said Letters Patent is hereby corrected as shown below:

Title page,
Item [56], U.S. PATENT DOCUMENTS insert:

| | | |
|---|---|---|
| -- 3,600,772 | 8/1971 | Diamond |
| 3,654,639 | 4/1972 | Lankheet |
| 3,840,908 | 10/1974 | Greene |
| 3,877,085 | 4/1975 | Bukaitz et al. |
| 4,023,217 | 5/1977 | Kessler |
| 4,413,361 | 11/1983 | Wolf et al. |
| 4,137,576 | 2/1979 | Greene |
| 5,010,603 | 4/1991 | Hertzog --. |

Signed and Sealed this

Twenty-first Day of January, 2003

JAMES E. ROGAN
*Director of the United States Patent and Trademark Office*